US005582229A

United States Patent [19]

Festl et al.

[11] Patent Number: 5,582,229

[45] Date of Patent: Dec. 10, 1996

[54] CONTINUOUS CASTING PLANT

[75] Inventors: Helmut Festl, Linz; Helmut Eidinger, Schönering; Richard Kasmader, Frankenmarkt, all of Austria

[73] Assignee: Voest-Alpine Industrieanlagenbau GmbH, Austria

[21] Appl. No.: 362,186

[22] Filed: Dec. 22, 1994

[30] Foreign Application Priority Data

Dec. 27, 1993 [AT] Austria ..... A2630/93

[51] Int. Cl.[6] ..... B22D 11/04

[52] U.S. Cl. ..... 164/418; 164/420; 164/436

[58] Field of Search ..... 164/418, 436, 164/420

[56] References Cited

U.S. PATENT DOCUMENTS

| | | | |
|---|---|---|---|
| 3,618,658 | 11/1971 | Gallucci | 164/418 X |
| 4,144,928 | 3/1979 | Rokop et al. | 164/418 |
| 4,516,622 | 5/1985 | Thone et al. | 164/418 X |
| 4,523,623 | 6/1985 | Holleis et al. | 164/436 |
| 4,562,876 | 1/1986 | Hargassner et al. | 164/418 X |
| 5,307,862 | 5/1994 | Sakata et al. | 164/436 |

FOREIGN PATENT DOCUMENTS

| | | | |
|---|---|---|---|
| 233187 | 9/1963 | Austria . | |
| 373516 | 6/1983 | Austria . | |
| 1508971 | 12/1969 | Germany . | |
| 2003787 | 10/1971 | Germany . | |
| 4132186 | 4/1993 | Germany . | |
| 58-41653 | 3/1983 | Japan | 164/418 |
| 63-90337 | 4/1988 | Japan | 164/436 |
| 1537358 | 1/1990 | U.S.S.R. | 164/418 |

*Primary Examiner*—J. Reed Batten, Jr.

*Attorney, Agent, or Firm*—Ostrolenk, Faber, Gerb & Soffen, LLP

[57] ABSTRACT

A continuous casting plant for the optional casting of an ingot of slab cross section or of ingots of smaller cross section has a first structural unit which is developed as plate mold for the casting of an ingot of slab cross section. This structural unit is supported on a mold support structure (1) and can be replaced by a second structural unit (16) having molds (21, 22, 23) for the casting of ingots of smaller cross section. For the dependable supporting of the molds (21, 22, 23) for the casting of a smaller cross section, the second structural unit (16) is formed of two longitudinal girders (17, 17') which are arranged spaced from and approximately parallel to each other and are rigidly connected to each other, the molds (21, 22, 23) being supported on the longitudinal girders (17, 17').

7 Claims, 3 Drawing Sheets

CONTINUOUS CASTING PLANT

BACKGROUND OF THE INVENTION

The present invention relates to a continuous casting plant for the casting of an ingot having a cross section of a slab or of ingots of smaller cross section, having a plate mold for the casting of an ingot of the cross section of slab, the wall of the wide and narrow sides of which are supported as a first structural unit on a mold support structure, said first structural unit being removable from the mold support structure for the casting of ingots of smaller cross sections and replaceable by a second structural unit having molds of smaller cross section.

In order to be able to use a continuous casting plant as universally as possible, it is desirable to be able to cast ingots of difference cross-sectional formats on one and the same continuous casting plant. For instance, it is desirable to be able to use a continuous casting plant for the casting of ingots having the cross-sectional format of a slab also for the casting of ingots having the cross section of a billet or bloom. Numerous solutions are known in order to achieve this.

From AT-B-233.187 it is known to use one or more additional narrow-side intermediate walls between the narrow side walls of a mold for a slab cross-sectional format so that two or more ingots of smaller cross section lying alongside of each other can be cast simultaneously with the mold dimensioned for a slab cross-sectional format. One problem in this connection, however, is represented by the fastening of the narrow-side intermediate walls which are additionally clamped between the wide-side walls and providing them with coolant, for which no solution is given in AT-B-233.187.

From Federal Republic of Germany B -2 003 787 an attachment is known for the additional narrow-side intermediate walls, in accordance with which a stationary intermediate partition wall is provided between the wide side walls and fastened to the wide-side walls. Plates of adjustable inclination are articulated on both sides to this stationary intermediate wall.

This construction has the disadvantage that the space required for the intermediate wall which is fastened to the wide-side walls is reduced and thereby the usable cross sections of the mold is reduced. Another disadvantage is that the adjustable attachment of the plates to the stationary intermediate wall requires structural parts which extend above and below the upper and lower edges respectively of the mold, so that, on the one hand, the upper covering of the mold must be provided at a greater distance away than customary, as a result of which the visibility into the mold is impaired and, on the other hand, end rollers cannot be placed directly on the lower end of the mold, as a result of which there is the danger of bulging of the ingot in the case of high casting output.

A construction similar to the continuous casting mold described in Federal Republic of Germany B 2 003 787 is known from Federal Republic of Germany A 41 32 186. In that case also, narrow-side intermediate walls can be inserted between the wide-side walls having structural parts which extend above the top of the mold.

From Federal Republic of Germany A 1 508 971 it is known to replace all the molds for the optional production of slabs and billets. This means that all supply lines must be interrupted and disconnected and then connected again after the replacement of the mold. Furthermore, work for the adjusting and readjustment of the molds is thus necessary.

From AT-B-373.516 a continuous casting plant of the type described above is known in which several ingots of smaller diameter are in a continuous slab casting plant. The wide-side walls of the continuous casting mold used here are developed identically, except for the copper plates which are arranged on the inner side, to the wide-side walls of a continuous casting plant for the casting of an ingot having slab cross section. The copper plates of the wide-side walls are divided in the longitudinal direction of the ingot by at least one recess between the narrow-side walls at the end, the intermediate narrow-side walls being inserted into the recesses. This construction results in an optimum utilization of the space.

SUMMARY OF THE INVENTION

It is an object of the present invention to further develop a continuous casting mold of the type described above in such a manner that simple maintenance of the molds of smaller cross-sectional format and replacement of a single one of such molds is possible. Furthermore, in the event that plate molds are used as molds of smaller cross section, all side walls of the second structural unit which are directed parallel to the narrow-side walls of the first structural unit can be clamped fast in simple fashion individually for each plate mold of smaller cross sectional format, it being of importance that predetermined clamping forces can be precisely maintained.

This object is achieved in accordance with the invention in the manner that the second structural unit is formed of two longitudinal girders which are arranged spaced apart and approximately parallel to each other and are rigidly connected to each other, on which girders the molds of smaller cross section are supported. By this construction, two or more molds can be inserted at the place of the plate mold of the casting of a mold of slab cross section, in which connection, however, due to the combining of the molds for the casting of ingots of smaller cross section into a structural unit, the molds can be inserted jointly in simple manner into the mold-support structure and removed again from it. The re-equipping of the continuous casting plant can therefore be effected within a very short period of time, in which connection adjustment work on the molds for the casting of ingots of smaller cross section can be carried out already before installation in the continuous casting plant.

In accordance with a preferred embodiment, plate molds which have first side walls which are approximately parallel to the longitudinal girders and between which second side walls can be clamped are provided as molds of the second structural unit.

For the simple supplying of coolant to the molds for the casting of ingots of smaller cross section, the mold support structure is provided with coolant connections for the second side walls.

The re-equipping of the continuous casting plant for the casting of an ingot of slab cross section for the casting of several ingots of smaller cross section, or vice versa, can be effected in particularly simple fashion if the longitudinal girders of the second structural unit can be connected to coolant feed and discharge pipes of the mold support structure for the wide-side walls of the first structural unit and are developed as coolant distributor for the first side walls of the plate molds of smaller cross section.

Other features and advantages of the present invention will become apparent from the following description of the invention which refers to the accompanying drawings.

BRIEF DESCRIPTION OF THE DRAWING(S)

The invention will be described below with reference to an embodiment shown in the drawing, in which FIG. 1 is a top view of a mold for the casting of an ingot of slab cross-sectional format;

FIG. 2 shows the mold after the re-equipping for the casting of three ingots of smaller cross section, also in top view but partially in section, shown diagrammatically, and FIG. 3 is an enlarged section taken along the line III—III of FIG. 2.

DETAILED DESCRIPTION OF THE INVENTION

Figure 1:
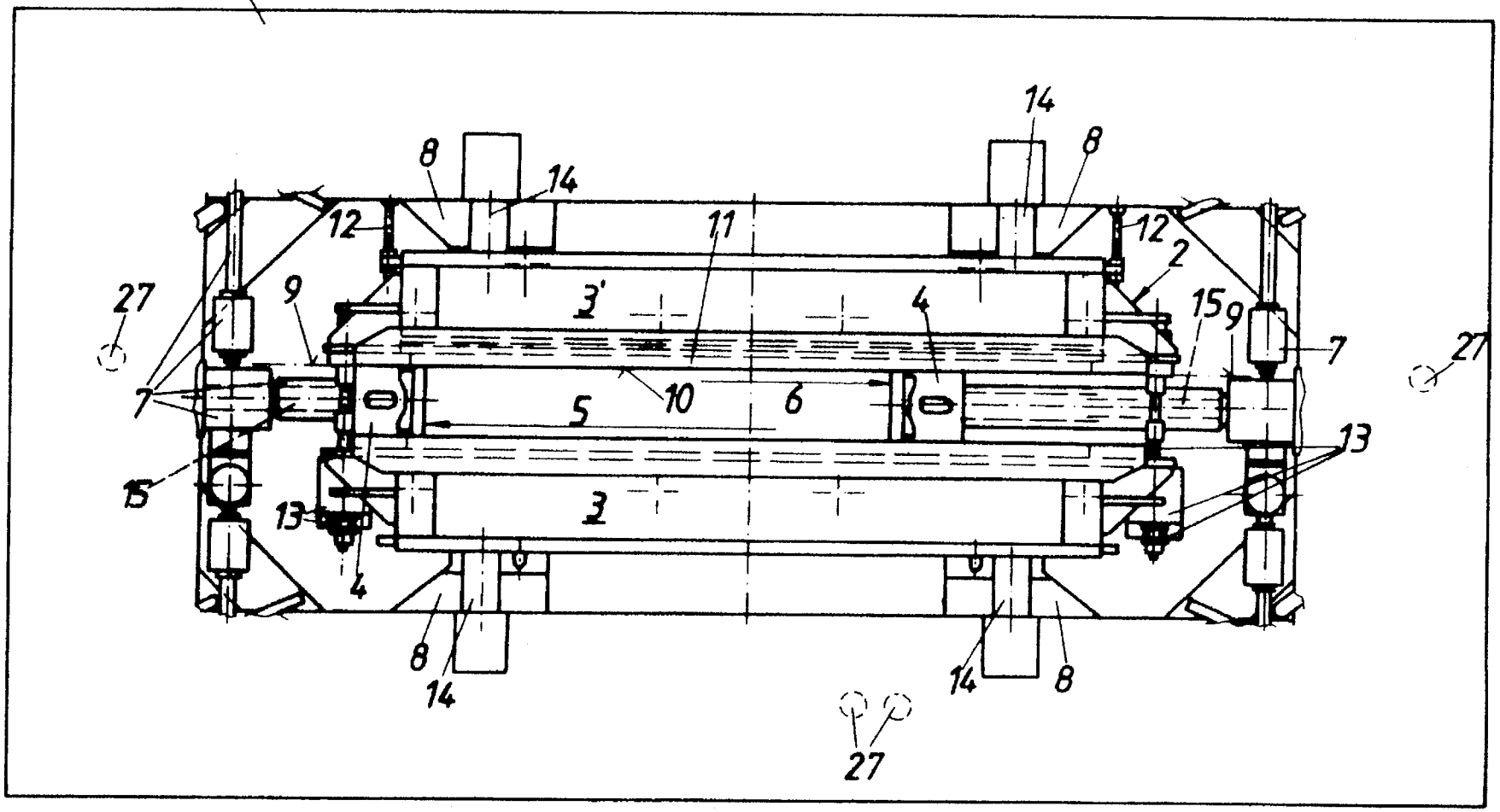
Figure 2:
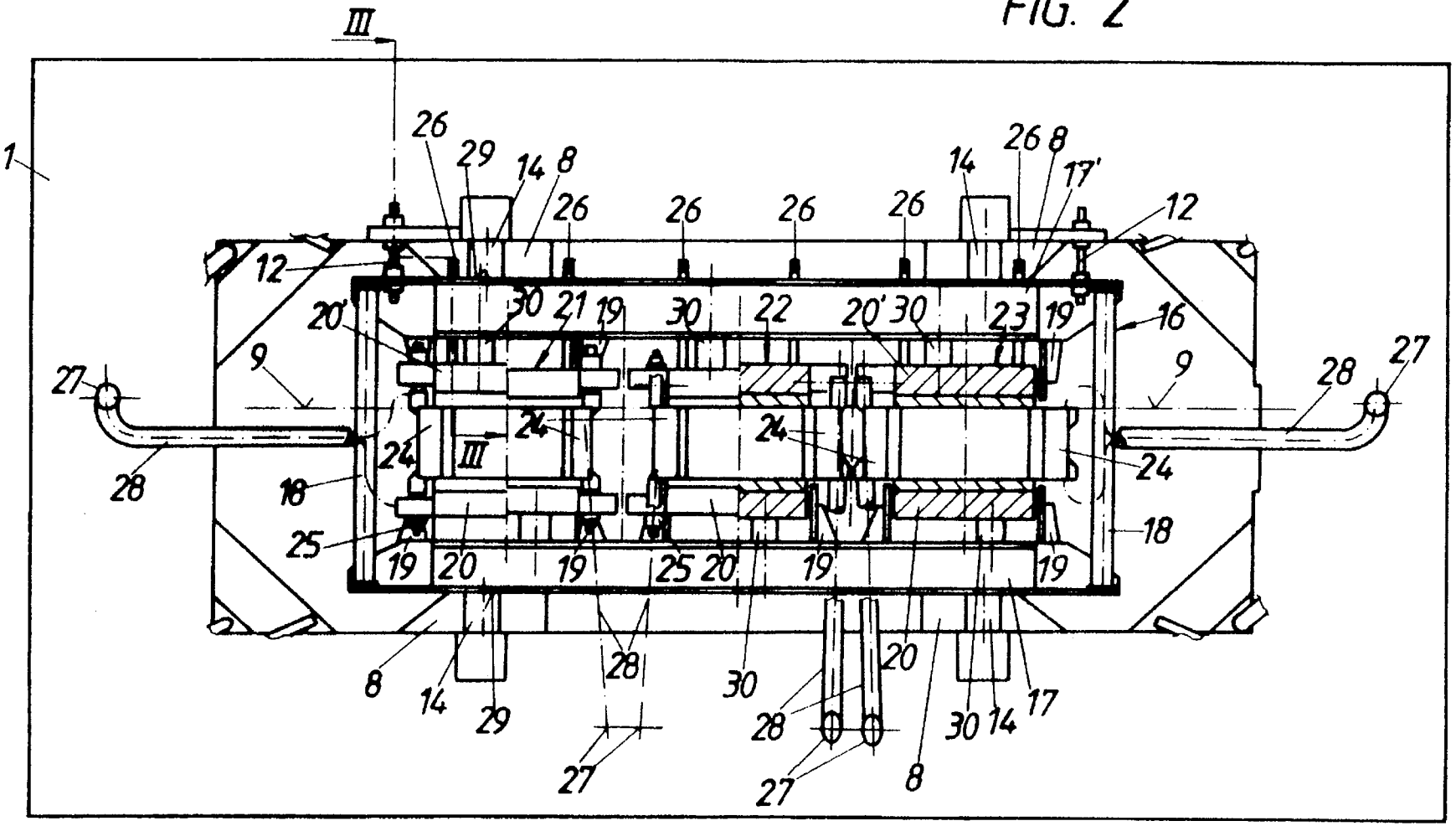
Figure 3:
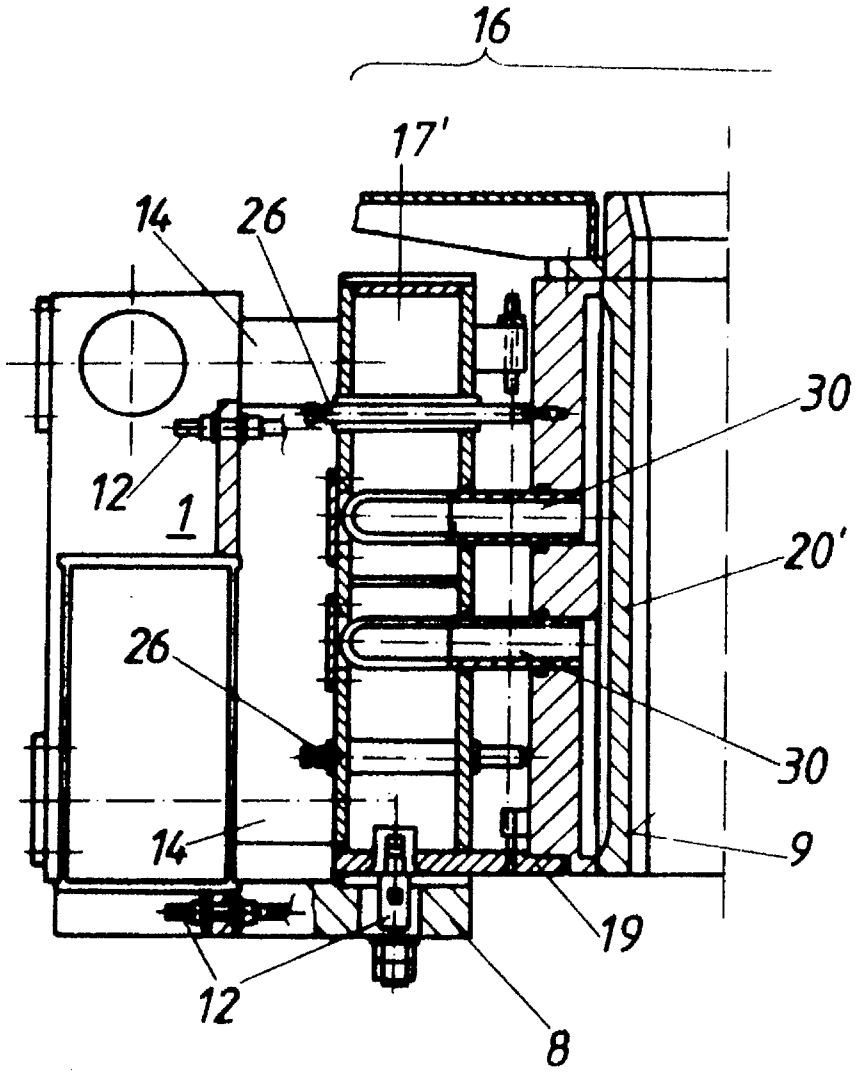

1 is a frame-like mold support structure which may be developed in raisable and lowerable manner, for instance as an elevating platform or be supported on an oscillating elevating platform. In accordance with FIG. 1, a first structural unit 2 which serves for the casting of an ingot of slab cross-sectional format is fastened to the mold support structure 1. This structural unit 2 has wide-side walls 3, 3' and narrow-side walls 4 which can be clamped fast between them, they being displaceable for adjustment of different slab widths 5, 6 by means of the setting drive 7 supported on the piston-supporting structure 1. The structural unit 2 is supported on the mold support structure 1 by brackets 8 which take up the weight thereof.

For the fixing of the mold on a stationary side 9—this is necessary for the alignment of the mold wide-side walls 3, i.e. the inner sides 10 of copper plates 11 with respect to the ingot guidance which follows the mold—there are provided adjusting devices 12 by which one of the wide-side walls, for instance the fixed side wall 3', can be adjusted, for instance, perpendicular to its length and in height with respect to the brackets 8. For the clamping of the narrow-side walls 4, clamping devices 13 are used which are provided at each of the ends of the wide-side walls 3, 3' and connect them together as well as pressing them together. They are actuated by spring or pneumatic cylinders.

The supplying of coolant to the wide-side walls 3, 3' is effected via coolant feed and discharge pipes 14, while the supplying of the narrow-side walls 4 is effected in customary manner via telescopically developed coolant feed and discharge pipes 15.

If it is now desired to re-equip the continuous casting plant for the casting of several ingots of smaller cross-sectional format, for instance of billet or bloom cross-sectional format, the first structural unit 2 is removed from the mold support structure 1. For this purpose, the adjusting means 12 for the fixing in position of the fixed side 9, and the coolant feed and discharge pipes 14 and 15 as well as the setting drive 7 for the displacement of the narrow-side walls 4 must be loosened from the mold support structure 1. Instead of this first structural unit 2, there is used in the invention a second structural unit 16 which has two longitudinal girders 17, 17' of any desired cross section, preferably developed as box girders, which are arranged approximately parallel to each other and in installed condition are also directed approximately parallel to the wide-side walls of the first—now removed—structural unit 2. The two longitudinal girders 17, 17' are rigidly connected to each other by transverse connections 18 and supported via the brackets 8 on the mold support structure 1. They serve again via brackets 19 fastened to them for the supporting of first side walls 20, 20', parallel to them, of the plate molds 21, 22, 23 for the casting of ingots of smaller cross section. Between the first side walls 20 there can be firmly clamped second side walls 24 which are directed parallel to the narrow-side walls 4 of the slab format mold, namely by clamping devices 25 which are formed by bolts or tie rods, etc. connecting the first two side walls 20 on the end.

The three plate molds 21, 22, 23 have their fixed sides 20', precisely aligned to each other and are fastened by means of adjusting devices 26 formed of screw bolts, rigidly to one of the longitudinal girders, namely to the longitudinal girder 17', which, in its turn, is fixed adjustably by the adjusting devices 12 similar to the first structural unit 2 with respect to the mold support structure 1. In this way, it is possible to adjust all plate molds 21, 22, 23 of the second structural unit 16 precisely on the fixed side 9.

The mold support structure 1 is provided with coolant connections 27 for the second side walls 24, so that the second side walls can be supplied in simple manner with coolant by connection of corresponding pipelines 28 (indicated only by their center lines in order not to clutter the drawing). The supplying of coolant to the first side walls 20, 20' takes place via the longitudinal girders 17, 17' which act as coolant distributor for these first side walls 20, 20'. The longitudinal girders are provided on the outside with coolant connections 29 into which the coolant line 14, which also serve for the supplying of the first structural unit 2, namely its wide-side walls 3, 3', can be inserted. On the inside of the longitudinal girders 17, 17', individual coolant feed and discharge pipes 30 are provided for each of the first side walls 20, 20'.

The invention is not limited to the embodiment shown in the drawing but can be modified in various manners. Instead of the plate molds 21, 22, 23, tube molds can possibly also be used. Furthermore, it would be conceivable, if only small quantities are to be cast, to provide only a single mold 21 of desired cross section in the second structural unit 16.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A continuous casting plant for the casting of an ingot of slab cross section or of ingots of smaller cross section, having a plate mold (2, 3, 3', 4) for the casting of an ingot of slab cross section the wide-side walls (3, 3') and narrow-side walls (4) of which are supported as first structural unit (2) on a mold support structure (1), which first structural unit (2) is removable from the mold support structure (1) for the casting of ingots of smaller cross section and replaceable by a second structural unit (16) having molds (21, 22, 23) of smaller cross section, characterized by the fact that the second structural unit (16) is formed by two longitudinal girders (17, 17') which are spaced from and approximately parallel to each other and are rigidly connected to each other, and on which the molds (21, 22, 23) of smaller cross section are supported.

2. A continuous casting plant according to claim 1, characterized by the fact that, as molds of the second structural unit, plate molds (21, 22, 23) are provided which have first side walls (20, 20') which are approximately parallel to the longitudinal girders (17, 17') and between which second side walls (24) can be clamped.

3. A continuous casting plant according to claim 1, characterized by the fact that the mold support structure (1) is provided with coolant connections (27) for the second side walls (24).

4. A continuous casting plant according to claim 3, characterized by the fact that the longitudinal girders (17, 17') of the second structural unit (16) are connectable to coolant feed and discharge pipes (14) of the mold support structure (1) for the wide-side walls (3, 3') of the first structural unit (2) and are developed as coolant distributor for the first side walls (20, 20') of the plate molds (21, 22, 23) of smaller cross section.

5. A continuous casting plant according to claim 2, characterized by the fact that the longitudinal girders (17, 17') of the second structural unit (16) are connectable to coolant feed and discharge pipes (14) of the mold support structure (1) for the wide-side walls (3, 3') of the first structural unit (2) and are developed as coolant distributor for the first side walls (20, 20') of the plate molds (21, 22, 23) of smaller cross section.

6. A continuous casting plant according to claim 2, characterized by the fact that the mold support structure (1) is provided with coolant connections (27) for the second side walls (24).

7. A continuous casting plant according to claim 6, characterized by the fact that the longitudinal girders (17, 17') of the second structural unit (16) are connectable to coolant feed and discharge pipes (14) of the mold support structure (1) for the wide-side walls (3, 3') of the first structural unit (2) and are developed as coolant distributor for the first side walls (20, 20') of the plate molds (21, 22, 23) of smaller cross section.

* * * * *